US007296665B2

(12) United States Patent
Morszeck

(10) Patent No.: US 7,296,665 B2
(45) Date of Patent: Nov. 20, 2007

(54) SUITCASE

(75) Inventor: Dieter Morszeck, Cologne (DE)

(73) Assignee: Rimowa GmbH, Cologne (DE)

( * ) Notice: Subject to any disclaimer, the term of this patent is extended or adjusted under 35 U.S.C. 154(b) by 0 days.

(21) Appl. No.: 10/553,831

(22) PCT Filed: Apr. 27, 2004

(86) PCT No.: PCT/EP2004/004421

§ 371 (c)(1),
(2), (4) Date: Oct. 20, 2005

(87) PCT Pub. No.: WO2004/095971

PCT Pub. Date: Nov. 11, 2004

(65) Prior Publication Data

US 2006/0201764 A1 Sep. 14, 2006

(30) Foreign Application Priority Data

Apr. 28, 2003 (DE) ..... 203 06 647 U

(51) Int. Cl.
*A45C 13/00* (2006.01)

(52) U.S. Cl. ..... 190/125; 190/901; 150/104; 150/145

(58) Field of Classification Search ..... 190/124, 190/127, 901; 180/104, 105, 145
See application file for complete search history.

(56) References Cited

U.S. PATENT DOCUMENTS

| | | | | |
|---|---|---|---|---|
| 2,157,833 | A * | 5/1939 | Plotkin | 190/125 |
| 3,623,580 | A * | 11/1971 | Toller | 190/115 |
| 3,861,504 | A * | 1/1975 | McGraw | 190/110 |
| 4,022,261 | A * | 5/1977 | Russell | 150/129 |
| 4,243,340 | A * | 1/1981 | MacGregor | 40/312 |
| 5,111,919 | A * | 5/1992 | Hamatani et al. | 190/109 |

FOREIGN PATENT DOCUMENTS

| | | | |
|---|---|---|---|
| GB | 2366512 | * | 3/2007 |
| JP | 11-299519 | * | 2/1999 |

* cited by examiner

*Primary Examiner*—Tri M. Mai
(74) *Attorney, Agent, or Firm*—Diller, Ramik & Wight

(57) ABSTRACT

In a suitcase (1) comprising two articulately joined case shells (2, 3), the case shells (2, 3) being closable with a closing means (4) on frame elements arranged at the edges of the case shells (2, 3), it is provided that at least one case shell (2, 3) is at least partly made of a transparent plastic material and a space for receiving a sheet (10) with an illustration thereon is provided behind the transparent part of the case shell (2, 3).

12 Claims, 2 Drawing Sheets

SUITCASE

This is a 371 of PCT/EP04/04421 filed Apr. 27, 2004 which claims priority to German Application 20306647.2, filed Apr. 28, 2003.

BACKGROUND OF THE INVENTION

The invention refers to a suitcase as defined in the preamble of claim 1.

Such shell suitcases, whose case shells are preferably made of plastic material or metal and which are hinged together at one edge of the case shells, are known. Frame elements are provided at the edges of the case shells, which have a closing means for closing the suitcase. Further, suitcases with two case shells are known that have a zipper as the closing means. The zipper may additionally be provided with a lock.

SUMMARY OF THE INVENTION

It is an object of the invention to provide a suitcase of the type mentioned above, wherein at least one of the major surfaces of the suitcase can be individually designed by the user.

This object is solved according to the invention by providing that at least one case shell is at least partly made of a transparent plastic material and that a space for receiving a sheet with an image thereon is provided behind the transparent part of the case shell. The invention advantageously allows to use the case shell individually in the manner of a quick change picture frame by inserting a sheet with a photograph or a graphic illustration thereon. The transparent part of the case shell is preferably located on the major surface of the case shell. The user may then individually provide the suitcase with a company name, advertising or an image. The owner of the suitcase may design one or both case shells according to his own individual ideas. Of course, it is also possible to not insert a sheet into the above space, the suitcase then showing the usual design.

Preferably, it is provided that at least one case shell has an outer shell and an inner shell, the respective outer shell being at least partly made of transparent plastic material. Preferably, the outer shell is entirely made of transparent plastic material, yet may be transparent only in parts thereof. The transparent outer shell supports the sheet inserted into the space so that the practical properties of the suitcase are not impaired.

The outer shell and/or the inner shell is/are surrounded by the frame element of the respective case shell. It is preferred that both shells of the respective case shell are surrounded, however, it is basically also possible to have only the outer shell or the inner shell be surrounded by the frame element.

If the inner shell is surrounded by the frame element, a punched cut is preferably made in the inner shell to facilitate the insertion of a sheet into the space.

The punched cut defines a supporting surface of the inner shell that can receive the sheet with an image thereon. Here, the punched cut is made such that the supporting surface remains integrally connected with the inner shell along a straight edge. The straight edge allows to pivot the supporting surface so as to be able to insert the sheet into the space and to position it on the supporting surface.

The inner shell is preferably covered by an inner lining that is at least partly removable. Due to the inner lining's being at least partly removable, the sheet can be inserted into the space. Because of the inner lining, the interior design of the suitcase does not differ from that of a normal suitcase.

Preferably, the case shells are made of polycarbonate.

The frame elements of the case shells may be made of plastic material or metal.

In a preferred embodiment, the frame elements are formed by a welt ribbon that encompasses the edge of the case shell and is sewn together with a zipper, acting as the closing means, and the edge.

The following is a detailed description of embodiments of the invention with reference to the drawings.

BRIEF DESCRIPTION OF THE PREFERRED EMBODIMENTS

Figure 1:
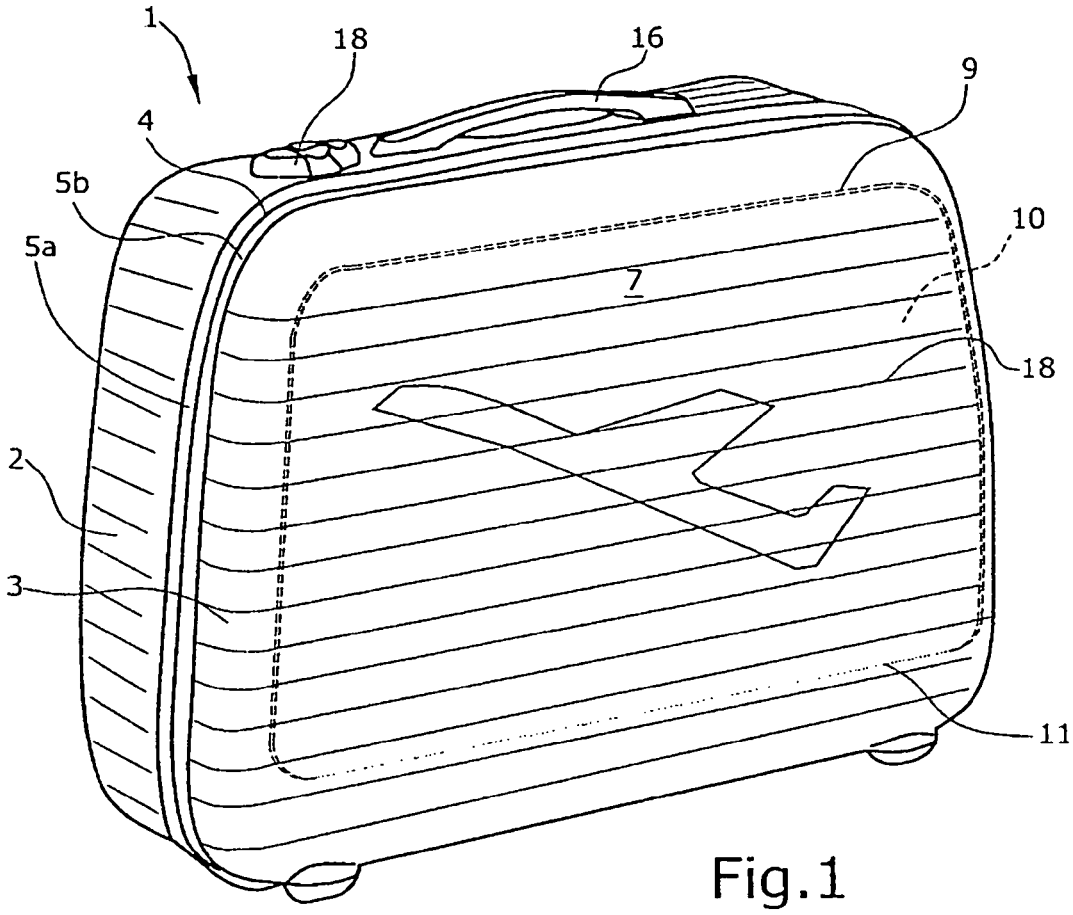
FIG. 1 is a perspective view of the suitcase of the present invention.

FIG. 1 illustrates a suitcase 1 with two case shells 2,3 joined by hinges at the bottom of the suitcase so as to be able to open an upper case shell 3. The edge of the case shells 2, 3 is provided with a closing means 4 in the form of a zipper that is sewn to the edges of the case shells 2, 3 together with welt ribbons 5*a*, 5*b*.

Figure 3:
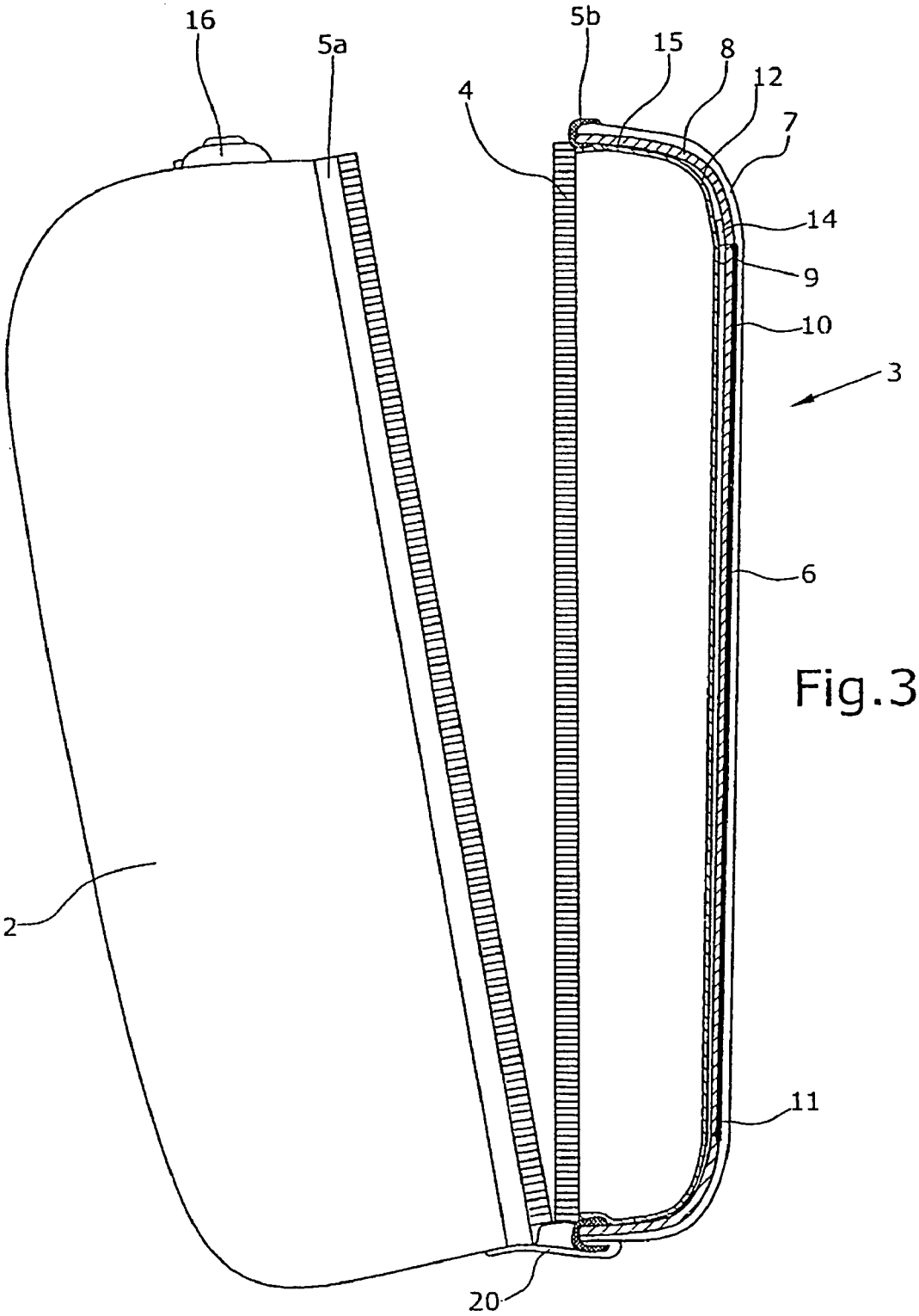
FIG. 3 is a sectional view of a suitcase designed according to the invention.

FIG. 3 shows the lower edge provided with a hinge element 20 with which the two case shells 2, 3 are hingedly connected.

The embodiments of FIGS. 1 and 3 illustrate a suitcase 1 with shell parts 2, 3 of different sizes, the larger bottom case shell 2 having a handle 16 on the top surface of the suitcase. In addition to the handle 16, a lock 18, preferably a combination lock, may be provided to which the pull tabs of the zipper may be attached and locked.

The case shells 2, 3, 7, 8 are preferably made of polycarbonate.

The top case shell 3 is made of a transparent outer shell 7 and an inner shell 8 colored the same as the case shell 2. Both the outer shell 7 and the inner shell 8 are sewn to the welt ribbon 5*b* and the zipper. In addition, an inner lining 15 is fastened to the inner side of the inner shell 8, the inner lining 15 being detachably fastened at least in the upper region, for example using a Velcro fastener 15 or a circumferentially extending Velcro tape.

Figure 2:
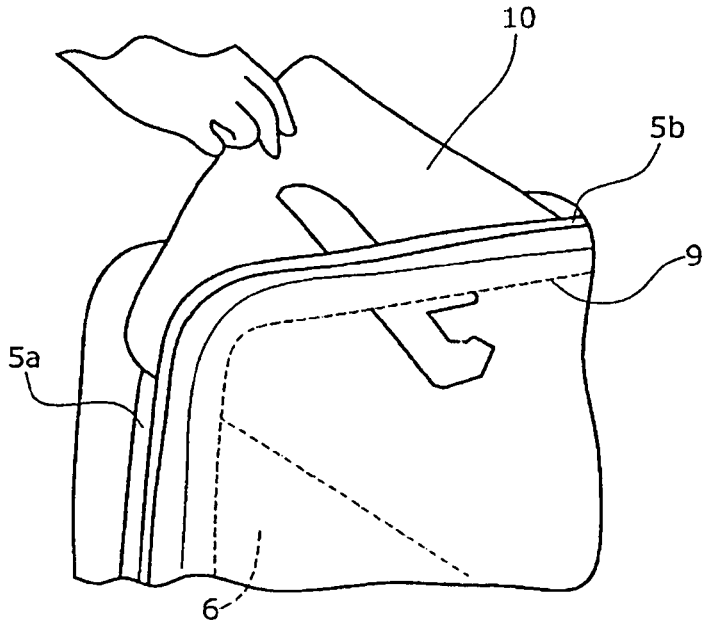
FIG. 2 illustrates the removable sheet.

Between the outer shell 7 and the inner shell 8, a space is provided into which a sheet 10 with an illustration thereon may be inserted, as is best seen in FIG. 2.

To this effect, not only the inner lining 12 may be detached at the top by means of the Velcro fastener 15, but the inner shell 8 is provided with a punched cut 9 allowing to pivot inward a part of the inner shell 8 that forms a supporting surface 6 for the sheet 10, so as to be able to insert the sheet 10 into the space, as illustrated in FIG. 2.

The punched cut 9 is preferably made on three sides of the supporting surface 6 of the inner shell 8 so that the supporting surface 6 may be pivoted about a straight edge 11 almost in the manner of a film hinge.

In FIG. 1, the illustration on the sheet 10 is visible through the transparent outer shell 8.

The illustration on the sheet 10 may show a photograph, a graphic representation, a company name or the like.

It is obvious that the punched cut may also have another shape and that both case shells 2, 3 may be equipped to receive a sheet 10. even the lateral faces of the case shell 2 may be designed accordingly.

In an alternative embodiment (not illustrated), it is also possible not to sew the outer shell 7 to the welt ribbon 5*b* or only at the bottom edge of the suitcase, so that the outer shell 7 may be pivoted outward with respect to the inner shell 8. In this case, the outer shell 7 is suitably fastened to the inner shell 8 at the lateral edges and/or at the upper edge, for example using push buttons. Also in this embodiment, a sheet 10 may be inserted between the outer shell 7 and the inner shell 8.

FIG. 1 shows a suitcase wherein the case shell 2 and the outer shell 7 have a horizontal groove structure 18, whereas FIG. 3 shows such a suitcase with a smooth suitcase surface.

Figure 4:
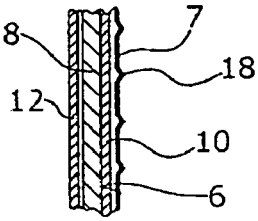
FIG. 4 is an enlarged sectional view of a case shell according to FIG. 1.

FIG. 4 shows a cross section through des case shell 3 of the embodiment in FIG. 1, wherein the outer shell 7 has the groove structure 18. The inner shell 8, receiving the sheet 10 on the supporting surface 6, has a smooth outer surface. The embodiment shows that a sheet 10 may be inserted even with a non planar surface of the outer shell 7.

Although a preferred embodiment of the invention has been specifically illustrated and described herein, it is to be understood that minor variations may be made in the apparatus and method without departing from the spirit and scope of the invention, as defined by the appended claims.

What is claimed is:

1. A suitcase (1) comprising:

two articulately joined case shells (2, 3), the case shells (2, 3) being closable by closing means (4) on frame elements (5*a*, 5*b*) arranged at edges of the case shells (2, 3), at least one case shell (2, 3) being at least partly made of a transparent plastic material, at least one case shell (2, 3) having an outer shell (7) at least partly made of transparent plastic material and an inner shell (8) between which a space for receiving a sheet (10) with an illustration thereon is provided behind the transparent part of the case shell (2, 3), the inner shell (8) includes an inverted substantially U-shaped punched cut (9) for inserting the sheet (10) into the space, the outer shell (7) and the inner shell (8) being each enclosed by a respective one of said frame elements (5*a*, 5*b*) of the respective case shells (2, 3), the punched cut (9) defining a supporting surface (6) for the sheet, and the supporting surface (6) remains connected to the inner shell (8) along a substantially straight edge (11).

2. The suitcase as defined in claim 1 wherein the inner shell (8) is covered by an inner lining (12) that is at least partly detachable.

3. The suitcase as defined in claim 1 wherein the case shells (2, 3, 7, 8) are made of polycarbonate.

4. The suitcase as defined in claim 1 wherein the frame elements of the case shells (2, 3, 7, 8) are made of plastic material.

5. The suitcase as defined in claim 1 wherein the frame elements (5*a*, 5*b*) are made of a welt ribbon sewn to the edge of the case shells (2, 3, 7, 8), and a zipper defining said closing means (4).

6. The suitcase as defined in claim 2 wherein the case shells (2, 3, 7, 8) are made of polycarbonate.

7. The suitcase as defined in claim 2 wherein the frame elements of the case shells (2, 3, 7, 8) are made of plastic material.

8. The suitcase as defined in claim 2 wherein the frame elements (5*a*, 5*b*) are made of a welt ribbon sewn to the edge of the case shells (2, 3, 7, 8), and a zipper defining said closing means (4).

9. The suitcase as defined in claim 6 wherein the frame elements of the case shells (2, 3, 7, 8) are made of plastic material.

10. The suitcase as defined in claim 6 wherein the frame elements (5*a*, 5*b*) are made of a welt ribbon sewn to the edge of the case shells (2, 3, 7, 8), and a zipper defining said closing means (4).

11. The suitcase as defined in claim 9 wherein the frame elements (5*a*, 5*b*) are made of a welt ribbon sewn to the edge of the case shells (2, 3, 7, 8), and a zipper defining said closing means (4).

12. The suitcase as defined in claim 1 wherein said inverted substantially U-shaped punch cut (9) is defined by a pair of leg cuts and a bight cut therebetween, and said straight edge (11) spans said leg cuts.

* * * * *